US007501608B2

(12) United States Patent
Hallgren et al.

(10) Patent No.: US 7,501,608 B2
(45) Date of Patent: Mar. 10, 2009

(54) MICROWAVE OVEN AND METHOD OF OPERATING A MICROWAVE OVEN

(75) Inventors: Fredrik Hallgren, Kolmarden (SE); Patrik Rydin, Skarblacka (SE); Per Torngren, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/945,633

(22) Filed: Nov. 27, 2007

(65) Prior Publication Data

US 2008/0121636 A1 May 29, 2008

(30) Foreign Application Priority Data

Nov. 28, 2006 (EP) ..... 06124892

(51) Int. Cl.
*H05B 6/68* (2006.01)

(52) U.S. Cl. ..... 219/705; 219/708; 219/710; 219/719; 219/689; 219/756; 219/762; 99/325; 99/451; 374/149

(58) Field of Classification Search ..... 219/702–714, 219/719, 762, 763, 756, 689, 518; 99/325, 99/451, DIG. 14; 374/149
See application file for complete search history.

(56) References Cited

U.S. PATENT DOCUMENTS 5,498,856 A * 3/1996 Carlsson ..... 219/689
6,844,535 B2 1/2005 Yang

FOREIGN PATENT DOCUMENTS

GB 2 280 829 * 2/1995 ..... 219/710
JP 4-65095 * 3/1992 ..... 219/703

* cited by examiner

*Primary Examiner*—Philip H Leung
(74) *Attorney, Agent, or Firm*—John Morrison; Michael D. Lafrenz

(57) ABSTRACT

The present invention provides a microwave oven and a method of operating a microwave oven, which minimises user involvement when heating a food item to a desired target temperature. According to the invention, the initial temperature of the food item is measured prior to the heating process, and the required heating time is determined automatically based on the initial temperature, the target temperature, and the amount of food as entered by the user. In order to heat a food item to a desired target temperature, the user only needs to position a container for temperature measurement and enter the amount of food. In particular, the present invention is preferably adapted for heating of baby food, such as baby milk contained in a baby bottle, and in such case the target temperature is preferably preset to about 37° C.

6 Claims, 2 Drawing Sheets

MICROWAVE OVEN AND METHOD OF OPERATING A MICROWAVE OVEN

BACKGROUND OF THE INVENTION

1. Field of the Invention

The present invention relates to domestic microwave ovens and to methods in domestic microwave ovens.

2. Description of the Related Art

In domestic microwave ovens, there is a commonly occurring problem in that users tend to either heat food items to excessively high temperatures or insufficiently heat food items. Users often set their microwave oven to an operating time which is expected to be too short for proper heating, and then open the door of the microwave oven to check on the current temperature of the food inside the oven, and then typically close the door and set an additional cooking time.

U.S. Pat. No. 6,844,535 discloses a microwave oven comprising a temperature-measuring device including a variable-length wire having one end thereof electrically connected to a controller in the microwave oven. The temperature-measuring device measures a temperature of an object outside of the cooking chamber and the temperature of food inside the cooking chamber. Although the temperature-measuring device to some degree facilitates heating to a desired temperature, the convenience for the user is still limited, and the construction of such microwave oven is fairly complicated.

SUMMARY OF THE INVENTION

An object of the present invention is therefore to provide a domestic microwave oven and a method for operating such microwave oven, which provide improvements with respect to heating of a food item to an appropriate temperature.

More particularly, it is an object of the present invention to provide a microwave oven in which an initial temperature of a food item to be heated is determined prior to the heating process by means of a temperature sensor arranged outside of the cavity of the microwave oven. Upon activation of the temperature sensor, a quantity (e.g. volume or weight) of the food item to be heated is inputted either automatically (by means of a weight or volume sensor) or by the user. Based upon the measured temperature of the food item, and upon the quantity detected by the sensor or indicated by the user, heating time and optionally also power level is selected automatically by a control program within the microwave oven.

It is particularly preferred to adapt the microwave oven of the present invention for use in heating food contained in a package or a container, as well as in heating milk or other foodstuff for infants contained in a baby bottle or similar. The temperature sensor may be provided on the front of the microwave oven, and may also be fitted with a cradle or similar for facilitating proper placement of the container in front of the temperature sensor. For heating the contents of the food package or baby bottle to an appropriate temperature, the package or bottle is first placed in the cradle within measuring distance of the temperature sensor. Responsive to the placement of the food product in the cradle, the control program of the microwave oven measures the current temperature of the contents in the package, container or bottle. Also responsive to the placement of the food product in the cradle, the user is prompted to operate input means on the microwave oven to input the quantity of contents to be heated. Instead of inputting such quantity manually, the cradle may also have the function of detecting the weight in order to provide automatically the central process unit of the microwave oven with such data. The weight/load sensor may be also placed inside the microwave oven cavity. Typically, for a baby bottle, the quantity will be entered in terms of volume, for example centiliters. For a package the quantity will be entered in terms of weight, for example grams. The user may also have an option of selecting a target temperature for the contents and an operating power for the microwave oven. However, in the case of a baby bottle, the target temperature is preferably set by default to about 37° C., and the power level to full power.

BRIEF DESCRIPTION OF THE DRAWINGS

In the following detailed description, reference is made to the drawings, on which.

DETAILED DESCRIPTION OF THE PREFERRED EMBODIMENTS

An embodiment of the present invention will be described in more detail below, with reference to the accompanying drawings.

Figure 1:
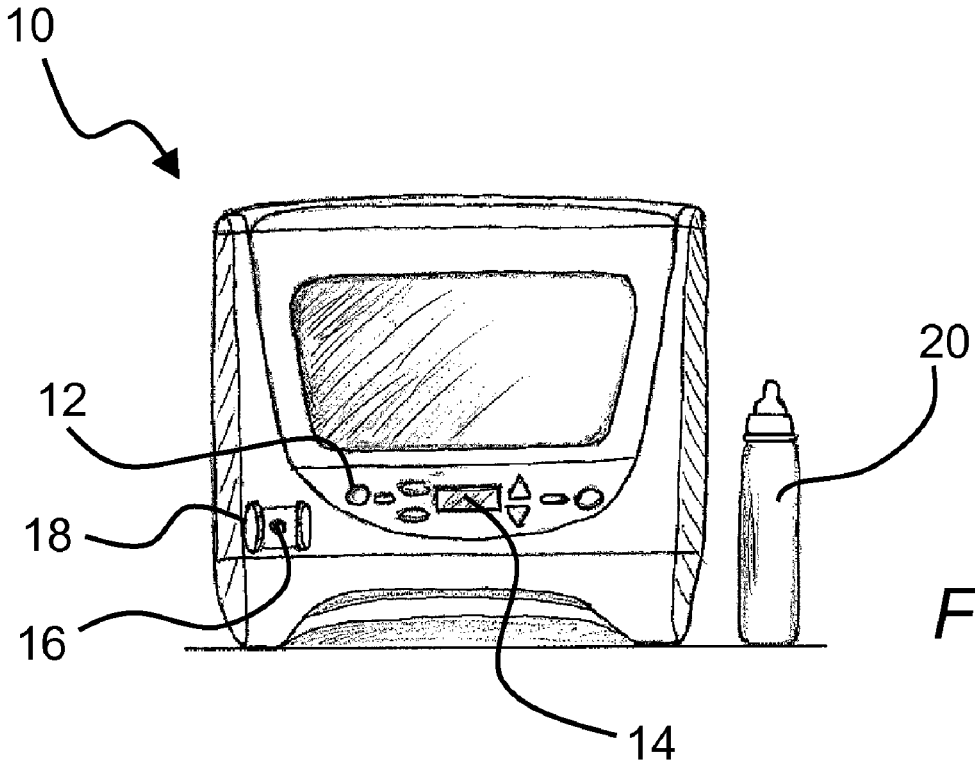
FIG. 1 schematically shows a microwave oven according to the present invention, designed for use with a baby bottle.

FIG. 1 schematically shows a typical domestic microwave oven 10. The microwave oven 10 is provided with usual push buttons and knobs, as indicated at 12, for setting operation parameters such as power level and heating time, as well as a display 14. According to the present invention, the microwave oven 10 is also provided with an external temperature sensor 16. As shown in FIG. 1, the temperature sensor 16 may be provided on the front of the microwave oven 10. The temperature sensor 16 is suitably an infrared sensor, which determines the temperature of the food item to be heated by means of its emission of infrared radiation. Suitably, there is also provided a cradle 18 or the like in connection with the temperature sensor 16. This cradle will facilitate correct placement of, for example, a baby bottle 20 at the temperature sensor 16. Preferably, there is also provided a switch or similar at the temperature sensor, the switch being activated when a container, such as the baby bottle 20, is placed in the cradle 18. Upon activation of the switch, various program steps may be performed in the oven 10. One such program step could be to prompt the user to input a quantity of the food item to be heated, or to input a desired target temperature for the heating process. As an alternative, one step of this program could also be an automatic detection of the weight of the food by a weight sensor, for instance a scale, associated with the cradle 18. In the case of a baby bottle the target temperature is preferably by default set to about 37° C. Nevertheless, it should be noted that the user could have the freedom to adjust the target temperature regardless of its default value.

At least in principle, density and heat capacity, as well as the ability to be heated by microwaves, of the food item will affect the power level and heating time for reaching the target temperature. However, for typical fluids that are heated in a microwave oven, experiments have indicated that these factors have relatively small influence on the final temperature. For a particular design aimed at heating the contents of a baby bottle, values which are valid for milk (similar to water) may be taken as the basis for determining adequate combinations of power level and operating time for reaching the target temperature.

Figure 2:
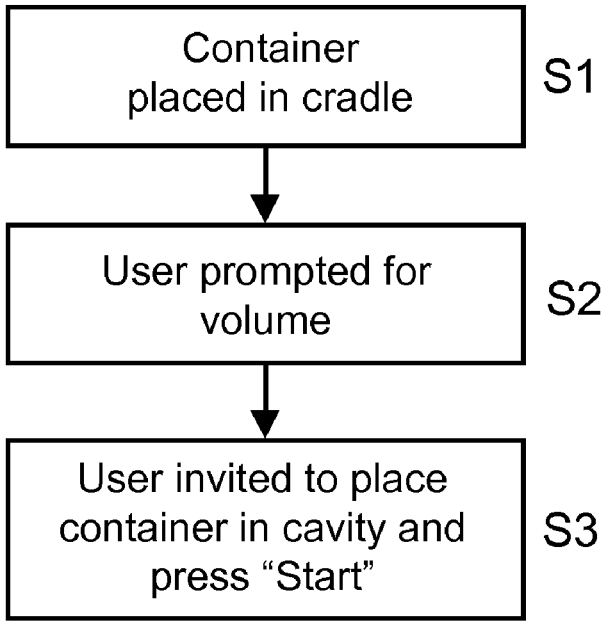
FIG. 2 is a flowchart showing the main steps experienced by a user of the inventive microwave oven.

As shown in the flowchart of FIG. 2, a method of operating the microwave oven typically starts when a baby bottle (or some other suitable container or food package) is positioned in the cradle. The placement of the container in the cradle will activate the switch. Once the switch has been activated, a temperature measurement is initiated and the control program of the microwave oven enters an operating mode for heating of baby bottle contents or package food contents. Once the switch has been activated, the user is also prompted to enter the quantity of liquid to be heated or a sensor detects automatically the weight of the food. The temperature measurement preferably continues until a stable temperature signal is obtained, in order to minimize the risk of an erroneous temperature measurement caused by temperature gradients within the liquid.

In the following step, in the case a weight sensor is not present, the user will enter the quantity of liquid (e.g. baby milk or pap) or the weight of food to be heated. The quantity is suitably entered in terms of volume or weight. Although the target temperature is preferably by default set to about 37° C. for the case of baby milk, the user may also be given the option to adjust the target temperature.

Once the temperature has been determined by means of the temperature sensor, and the quantity of liquid or food to be heated has been entered by the user or by the sensor, the control program of the microwave oven calculates an appropriate combination of power level and heating time for the microwave oven in order for the liquid or solid to reach the target temperature. The user is given an indication to the effect that the microwave oven is ready to heat the contents of the container. The user may then place the container in the cavity of the microwave oven and press a "Start" button or similar to initiate the heating process. The indication that the microwave oven is ready to heat the liquid or food can be given to the user even when the microwave oven has not already calculated the appropriate combination of power level and heating time, since the value of quantity of liquid or food is missing. This is for instance the case when a weight/load sensor or scale is placed inside the cavity, associated for instance to the turntable of the microwave oven. In this case the microwave oven will detect automatically the value and the above calculation process will start immediately when the user closes the door or start the heating process by pressing the "Start" button.

Once the heating process is complete, the user may as an option be given the possibility to check the final temperature of the heated liquid. Suitably, if the user wants to check the final temperature, the container is once again positioned in the cradle at the temperature sensor and the temperature of the contents is displayed on the front panel of the microwave oven. In order to get an accurate value for the final temperature, the user may need to shake the container before placing it in the container, in order to even out any temperature gradients within the liquid.

The steps indicated in FIG. 2 are the main steps experienced by the user. As will be explained below, however, there are a number of additional steps performed within the microwave oven during operation.

Although, there are a number of combinations of power level and heating time that will result in the desired target temperature, the microwave oven is suitably operated at maximum power during the heating of the liquid. Since it is straightforward to shake the bottle after heating to even out any temperature differences, the inconveniences of so-called hot spots and cold spots, often experienced for solid food items, are in practise of no relevance.

The present invention thus provides a simple and reliable way of heating the contents of a container to a desired target temperature by measuring an initial temperature and automatically setting power level and operating time in order for the contents to reach the target temperature. A microwave oven according to the present invention has a comparatively simple construction, and no temperature sensor need to be arranged within the microwave cavity. The heating time (and optionally a suitable power level) is determined based on the measured initial temperature of the food item to be heated before the heating operation is initiated.

The control program of the microwave oven may be provided with a look-up table in which starting temperatures (initial temperatures) are related to target temperatures by suitable heating times and power levels. More preferably, however, appropriate heating time and power level are calculated from a mathematical relation.

Appropriate heating time for reaching the target temperature for the contents to be heated may be calculated from its initial temperature, specific heat and mass. Generally, the relation between power and heating time on the one hand, and temperature rise on the other hand, is given by:

$$P \cdot t \sim m \cdot C_p \cdot \Delta T \quad (1)$$

where P is the heating power, m is the mass of the item to be heated, $C_p$ is the heat capacity at constant pressure, and $\Delta T$ is the temperature rise after time t. From relation (1), it is straightforward to determine the appropriate heating time in each situation.

Assume, for example, a situation where a quantity of baby milk is to be heated to a typical consumption temperature of about 37° C. The physical characteristics of baby milk may, for the purposes of microwave heating, be approximated to those of water. Thus, it may be assumed that the heat capacity is about $4.18 \cdot 10^3$ J/(kg·K) and that the density is about 1 g/cm$^3$. For a volume of about 200 ml (i.e. 0.2 kg) and an initial temperature of about 10° C., and assuming a microwave power of about 750 W, an appropriate heating time is obtained as:

$$0.2 \cdot 4.18 \cdot 10^3 \cdot (37-10)/750 = 30 \text{ seconds}$$

In embodiments of the present invention, it is conceivable that different programs may be selected for different types of foodstuff, where an appropriate value of $C_p$ is assumed for each program. However, the value of $C_p$ may by default be set to that of water, i.e. $C_p = 4.18 \cdot 10^3$ J/(kg·K).

The initial temperature is, according to the present invention, measured prior to the heating operation by means of the external temperature sensor of the microwave oven. Any suitable type of temperature sensor may be used for this purpose. One example of a suitable temperature sensor is Perkin Elmer IR Sensor Type TPMF710. This preferred temperature sensor includes focussing optics and interface electronics, and delivers an output voltage that is proportional to the temperature of the measured surface and which is compensated for the ambient temperature. The table below shows the output voltage $V_{out}$ for a number of different measured temperatures $T_{object}$ for this sensor.

Perkin Elmer IR Sensor Type TPMF710

| $T_{object}$ [° C.] | $V_{out}$ [V] |
|---|---|
| 0 | 1.388 |
| 10 | 1.7895 |
| 20 | 2.191 |
| 30 | 2.679 |
| 40 | 3.203 |
| 50 | 3.829 |

From the values given in the table above, the measured temperature of the object can be determined by a linear interpolation as follows. Let $V'_{out}$ be the instant output voltage from the temperature sensor, and let $V_T$ and $V_{T+10}$ be the closest value in the above table immediately below and above, respectively, the instant output voltage $V'_{out}$. In addition, let $T_T$ be the table temperature value corresponding to $V_T$ (for example, $T_T$=20° C. corresponds to $V_T$=2.191 V in the table above). The following relation then applies:

$$\text{If } (V'_{out} \geqq V_T) \text{ AND } (V'_{out} < V_{T+10}) \text{ then}$$

$$T_{object} = T_T + (V'_{out} - V_T)/(V_{T+10} - V_T) \cdot 10$$

EXAMPLE $$\text{If } V'_{out} = 2.913 \text{ V, then}$$

$$T_{object} = 30 + (2.913 - 2.679)/(3.203 - 2.679) \cdot 10$$

$$T_{object} \approx 34.5° \text{ C.}$$

Figure 3:
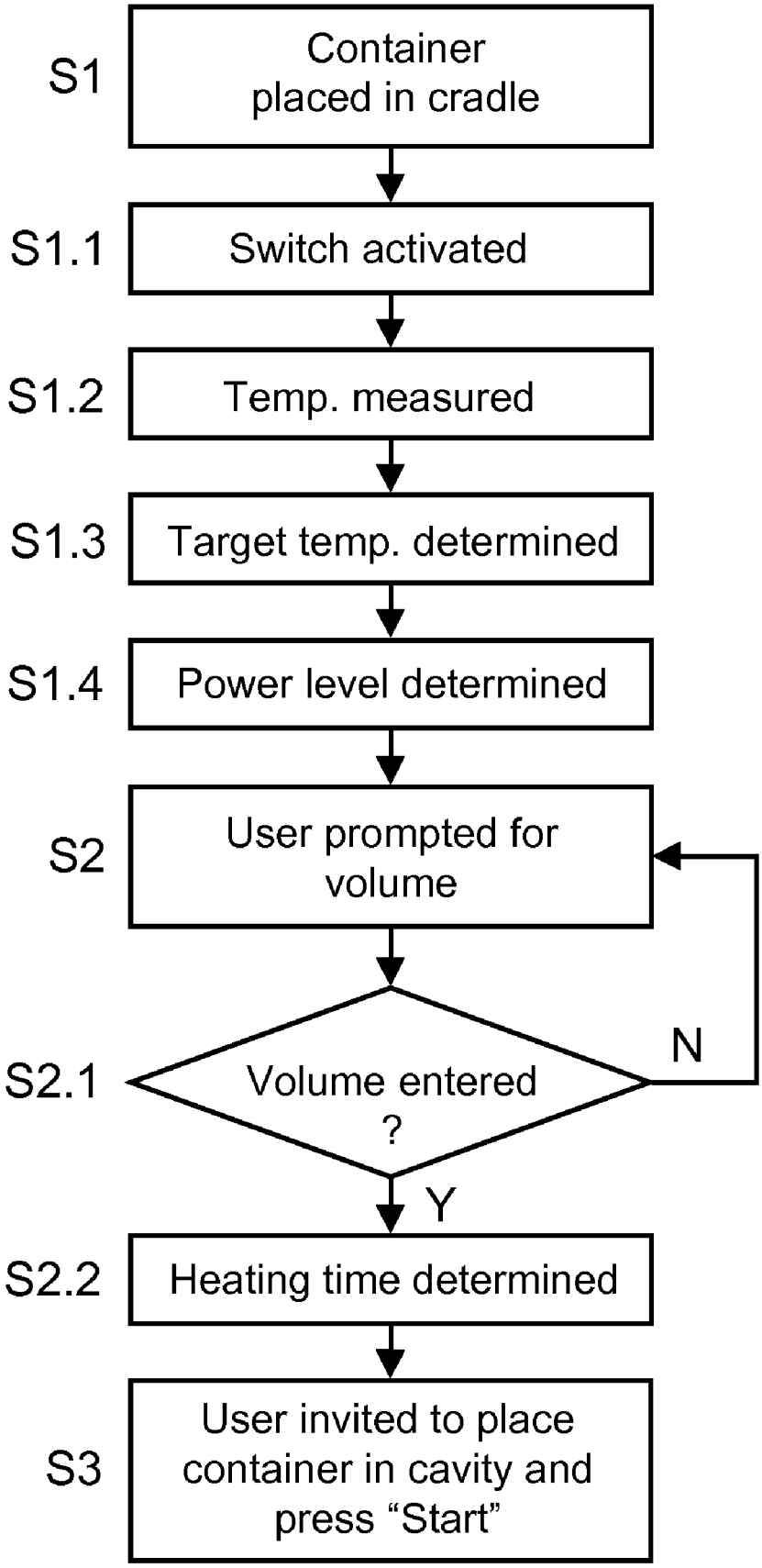
FIG. 3 is a flowchart outlining in more detail the steps in a method according to the invention.

The method according to the present invention for heating of a food item to a desired target temperature will be explained in more detail with reference to the flowchart of FIG. 3.

The method starts when a container is placed in the cradle in front of the temperature sensor. When the container is placed in the cradle, a switch is activated, which initiates a control program in the microwave oven. In order for the control program to determine the appropriate heating time, values for the mass to be heated, its heat capacity, the target temperature, the initial temperature and the microwave power level must be known. Upon activation of the switch, the temperature of the contents in the container is measured by means of the temperature sensor in the manner explained above, and the initial temperature is obtained as an input value for determining the heating time. As explained above, the heat capacity is preferably preset to that of water, although means may be provided for the user to input or select another value. The mass of the food item to be heated is obtained by prompting the user to input a corresponding value, e.g. the volume to be heated, or, in an alternative embodiment, a sensor associated to the cradle detects automatically such value and feeds it to the control process unit of the microwave oven. The user may also be prompted to input the target temperature, although is may advantageously be preset to about 37° C. for the case of baby bottles containing the food to be heated (since about 37° C. is a recommended consumption temperature for baby food). In addition, the user may have the option of selecting a power level for the microwave oven. However, it may be convenient to have the power level set by default to maximum power when liquid foodstuff is to be heated.

Hence, as indicated, the target temperature and power level are determined, either as default values or as entered by the user. Then, before the heating time can be determined, the program waits until the user enters the quantity to be heated, as indicated, in the case no weight sensor is present.

Once the heating time has been determined, based on the input values, the user is invited to place the container (e.g. baby bottle or food package) in the microwave cavity and press "Start" to initiate the heating.

The heating time determination can be performed once all required input values have been determined. It should be understood, however, that these input values (required for equation (1) above) could be acquired in any order and hence not necessarily in the order indicated in FIG. 3. It does not matter how or in which order these values are obtained. The determination of the heating time could be made at any time before the actual heating is initiated. It is even conceivable that the heating time is determined after the user has placed the food item in the microwave cavity and pressed the "Start" button.

After the heating has been completed, the user may be given the option to once again position the container in the cradle, in order to verify that the target temperature has been reached. The temperature of the contents may then be shown on the display of the microwave oven.

In addition to milk contained in a baby bottle, the method and the microwave oven according to the present invention can be used as well for heating other food, for instance fish, meat, vegetable soups etc. which are preferably pre-cooked and have to be only heated to desired serving temperature in the microwave oven. Also in this case the oven level of power and heating time will be calculated on the basis of quantity and starting temperature of the food. Depending on the food category, the final heating temperature can be usually in the range about 60° C.-75° C. (fish close to about 60° C., soup close to about 75° C.). The food is contained in a package that can be a sealed plastic bag (for instance under vacuum) or a paper container. The food category can be entered by the user or can be detected automatically by the oven through a bar code reader, for instance simultaneously with temperature (and optionally quantity) detection.

The present invention provides a microwave oven and a method of operating a microwave oven, which minimises user involvement when heating a food item to a desired target temperature. According to the invention, the initial temperature of the food item is measured prior to the heating process, and the required heating time is determined automatically based on the initial temperature, the target temperature, and the amount of food automatically detected or entered by the user. In order to heat a food item to a desired target temperature, the user only needs to position a container for temperature measurement. In particular, the present invention is preferably adapted for heating of baby food, such as baby milk contained in a baby bottle, and in such case the target temperature is preferably preset to about 37° C.

We claim:

1. A method of operating a microwave oven, comprising the steps of:

automatically measuring an initial temperature of a food item contained in a container in response to activation of a switch that indicates the container has been positioned for temperature measurement wherein the step of measuring the initial temperature is performed repeatedly until a stable temperature signal is obtained;

inputting a food category;

automatically setting a target temperature for the food item based on the inputted food category;

automatically inputting a value for the quantity of the food item to be heated based on a sensor;

determining a heating time based on the initial temperature, the target temperature, and the quantity;

heating the food item for the heating time; and inviting the user to position the container in front of the temperature sensor after the heating has been completed in order to verify that the target temperature has been reached.

2. The method according to claim 1, wherein the target temperature is set by default to about 37° C. for heating of baby food.

3. The method according to claim 1, further comprising the step of prompting a user to input a desired microwave power level, and wherein the heating time is determined based on the desired microwave power level.

4. The method according to claim 1, further comprising the step of inviting the user to place the food item in the microwave oven and initiate heating once the initial temperature has been measured.

5. A microwave oven, comprising a microwave cavity adapted to receive a food item contained in a container to be heated;

a temperature sensor arranged outside of the microwave cavity;

a cradle arranged at the temperature sensor for facilitating correct positioning of a container in front of the temperature sensor;

a weight or volume sensor arranged at the cradle for entering a quantity of food for the food item;

input means for entering by a user a category of food to be heated;

a switch associated with the temperature sensor, wherein the switch is activated when the container is positioned for temperature measurement, and wherein the temperature of the food item is measured responsive to the activation of the switch; and means for determining a heating time for the food item based upon an initial temperature of the food item as measured by the temperature sensor, a desired target temperature based on the food category inputted by the user, and the quantity of the food item as entered by the weight or volume sensor.

6. The microwave oven according to claim 5, in which a control program for heating of baby bottle contents is automatically initiated upon activation of the switch.

* * * * *